US006382288B1

(12) United States Patent
Park et al.

(10) Patent No.: US 6,382,288 B1
(45) Date of Patent: May 7, 2002

(54) TAPE FEEDING SYSTEM FOR TAPING APPARATUS

(75) Inventors: Dong Hoon Park; Hyung Gyun An, both of Suwon; Jae Gyu Kim, Seoul, all of (KR)

(73) Assignee: Samsung Electro-Mechanics Co., LTD, Suwon (KR)

( * ) Notice: Subject to any disclaimer, the term of this patent is extended or adjusted under 35 U.S.C. 154(b) by 0 days.

(21) Appl. No.: 09/330,396

(22) Filed: Jun. 11, 1999

Related U.S. Application Data

(62) Division of application No. 08/938,217, filed on Sep. 26, 1997, now Pat. No. 5,954,919.

(30) Foreign Application Priority Data

Dec. 10, 1996 (KR) ..... 96-63747
Dec. 10, 1996 (KR) ..... 96-64984

(51) Int. Cl.[7] ..... B32B 31/00; B32B 31/04

(52) U.S. Cl. ..... 156/468; 156/475; 156/485; 156/486; 156/488

(58) Field of Search ..... 156/468, 475, 156/485, 486, 488

(56) References Cited

U.S. PATENT DOCUMENTS

| | | | |
|---|---|---|---|
| 1,944,142 | A | 1/1934 | Abbott, Jr. et al. |
| 3,221,468 | A | 12/1965 | Casey |
| 3,389,039 | A | 6/1968 | Steckler |
| 3,414,451 | A | 12/1968 | Sejda |
| 3,466,847 | A | 9/1969 | Farkas |
| 3,547,737 | A | 12/1970 | Vici |
| 4,204,905 | A | 5/1980 | Miyamoto |
| 4,264,398 | A | 4/1981 | Pruitt |
| 4,502,905 | A | 3/1985 | Jung et al. |
| 4,602,976 | A | 7/1986 | Fukuda et al. |
| 4,790,896 | A | 12/1988 | Schmalhotz |
| 4,961,815 | A | 10/1990 | Buckley et al. |
| 5,271,791 | A | 12/1993 | Tanaka |

*Primary Examiner*—Adrienne C. Johnstone
(74) *Attorney, Agent, or Firm*—Ladas & Parry

(57) ABSTRACT

The present invention relates to an improved taping apparatus which comprises a cam mechanism and a belt member disposed around the circumferential surface of the cam mechanism, whereby the belt member rotating along the periphery of the cam mechanism can continuously apply a tape around a peripheral surface of the object, in particular in the shape of a closed-loop, while the object is disposed within the central space of the cam mechanism, so that the tape can be automatically applied around the object and the productivity can be improved. The taping apparatus is characterized by an annular cam mechanism supported at both sides by frames and having an entrance formed through a part of the cam mechanism, through which entrance the object to be taped can be introduced into the central space of the cam mechanism; an annular belt member loosely encompassing the peripheral surface of the cam mechanism and extended across the entrance, so that when the object is introduced into the central space of the cam mechanism through the entrance, the belt member can be stretched and bring the tape into tight contact with the surface of the object; and a drive unit for rotating the cam mechanism so that the belt member can continuously contact the peripheral surface of the object and simultaneously apply the tape around the object.

2 Claims, 9 Drawing Sheets

TAPE FEEDING SYSTEM FOR TAPING APPARATUS

This is a divisional of copending application Ser. No. 08/938,217 filed on Sep. 26, 1997, now U.S. Pat. No. 5,954,919, claims the benefit thereof and incorporates the same by reference.

BACKGROUND OF THE INVENTION

1. Field of the Invention

The present invention relates to taping apparatus, in particular to taping apparatus which can apply an adhesive tape around a closed-loop shaped object (e.g. a neck band formed within a horizontal deflection coil of a deflection yoke) in a continuous operation.

2. Description of the Prior Art

In general, apparatus for taping an adhesive tape around an object typically has a construction as shown in FIG. 1. When a tape 6 is unwound and lowered an a predetermined distance from the tape reel 4, and then moved toward the object by a moving member 5*a,* horizontal and vertical moving rollers 1*a* and 1*b* which are respectively displaced by a horizontally movable cylinder 1 and a vertically movable cylinder 2 will apply the tape around the peripheral surface of the object 3. With the conventional taping apparatus constructed in this manner, a length of the tape 6 moved toward the object 3 is cut by a tape cutter 7 and then adhered on the peripheral surface of the object 3 by the horizontally and vertically moving rollers 1*a* and 2*b,* which are moved forward and backward by the cylinders 1 and 2, respectively.

However, the taping apparatus of the above type has disadvantages in that its taping operation should be precisely conducted since the tape 6 is applied while the two cylinders 1 and 2, which are independent from each other, perform linear displacements in a connective manner, and in that the time needed for the taping operation is very long since those cylinders move alternately and sequentially. Furthermore, the winding turns of the tape are relatively limited since the tape may deviate from the determined running path during the taping operation and the apparatus lacks compatibility since the mechanical conditions have to be changed whenever the types and sizes of objects to be taped are varied.

SUMMARY OF THE INVENTION

The present invention is conceived to solve the problems of the prior art and the purpose of the present invention is to provide an improved taping apparatus which comprises a cam mechanism and a belt member disposed around the circumferential surface of the cam mechanism, whereby the belt member rotating along the periphery of the cam mechanism can continuously apply a tape around a peripheral surface of the object, in particular in the shape of a closed-loop, while the object is disposed within the central space of the cam mechanism, so that the tape can be automatically applied around the object and the productivity can be improved.

In order to achieve the above purpose, the present invention provides taping apparatus characterized in that it comprise an annular cam mechanism supported at both sides by frames and having an entrance formed through a part of the cam mechanism, through which entrance the object to be taped can be introduced into the central space of the cam mechanism; an annular belt member loosely encompassing the peripheral surface of the cam mechanism and extended across the entrance, so that when the object is introduced into the central space of the cam mechanism through the entrance, the belt member can be stretched and bring the tape into tight contact with the surface of the object; and means for rotating the cam mechanism so that the belt member can continuously contact the peripheral surface of the object and simultaneously apply the tape around the object.

DESCRIPTION OF THE PREFERRED EMBODIMENTS

Figure 1A:
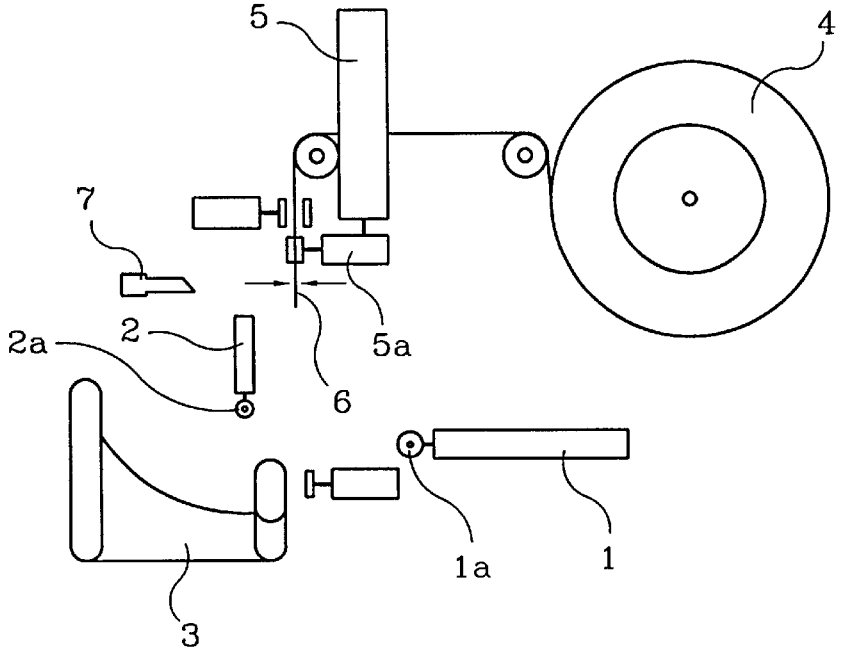
FIG. 1a PRIOR ART
FIGS. 1*a* to 1*f* are simplified views diagrammatically showing the operating conditions of a conventional taping apparatus in sequence.
Figure 1B:
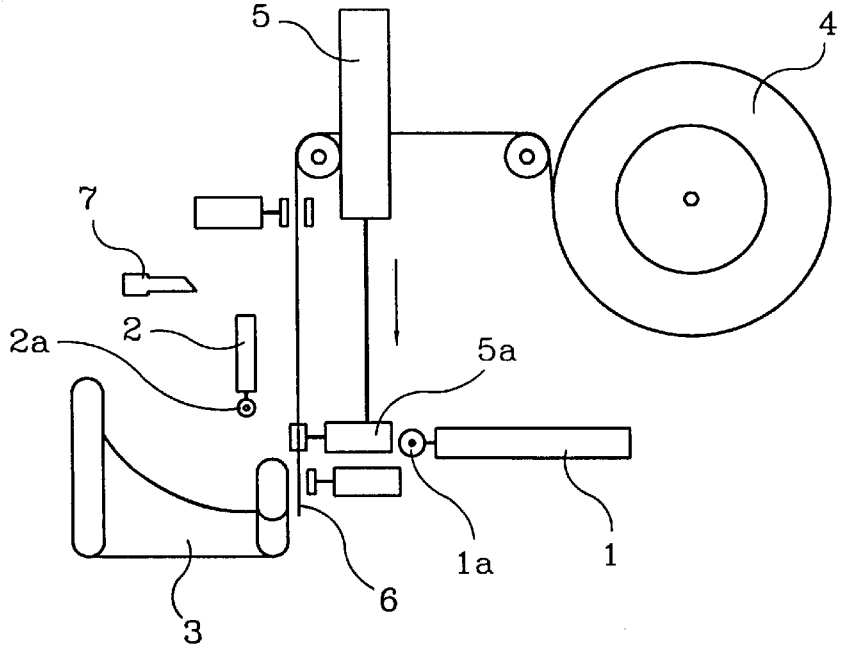
FIG. 1b PRIOR ART
Figure 1C:
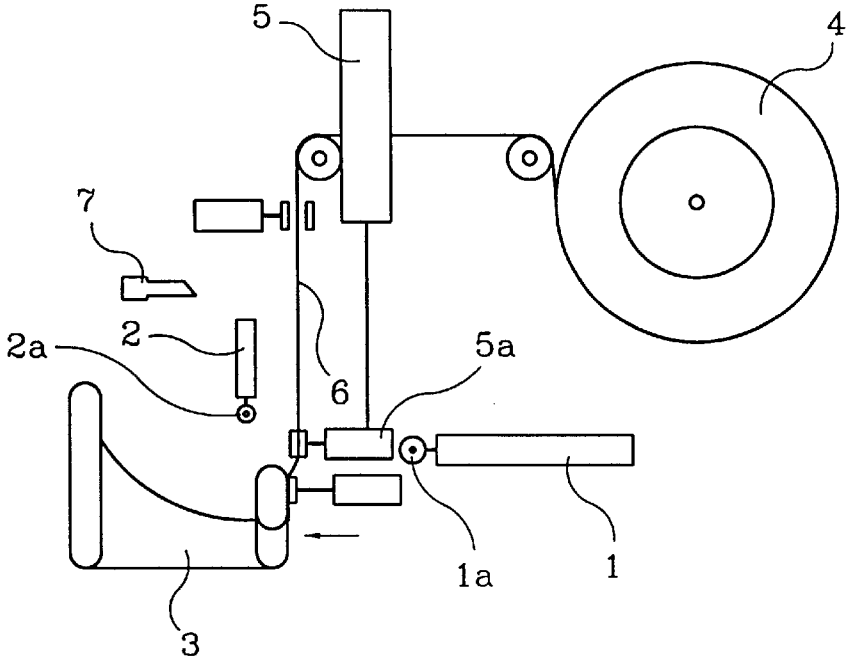
FIG. 1c PRIOR ART
Figure 1D:
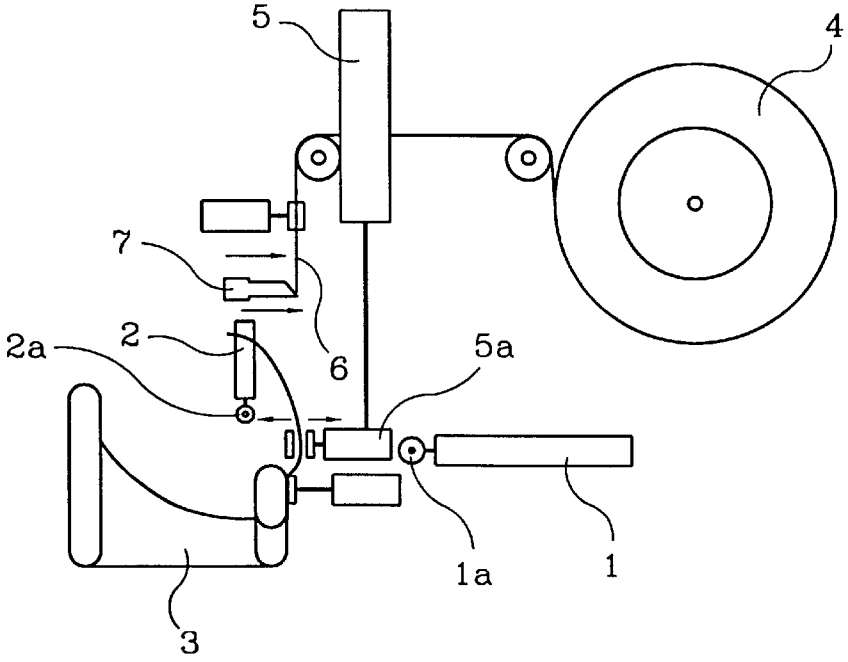
FIG. 1d PRIOR ART
Figure 1E:
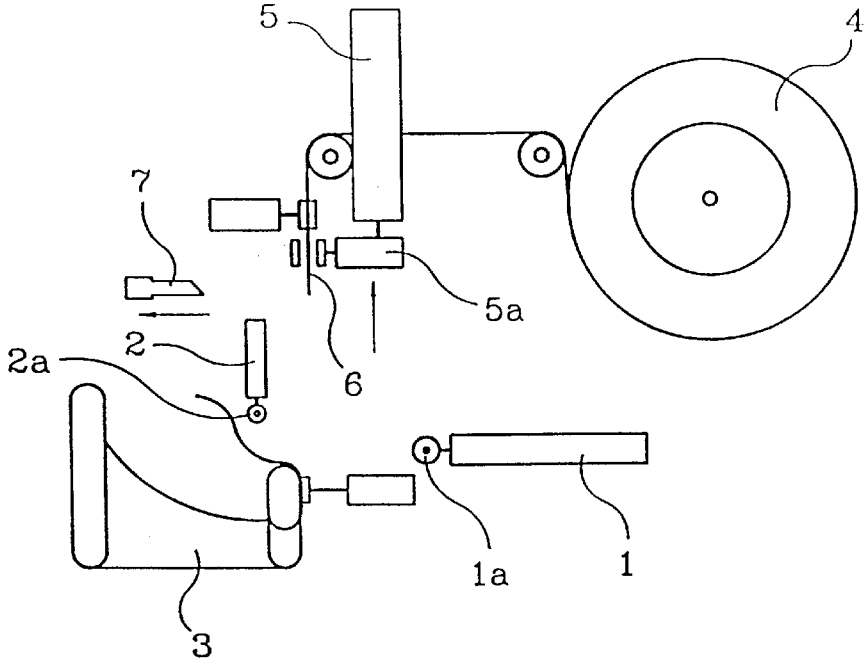
FIG. 1e PRIOR ART
Figure 1F:
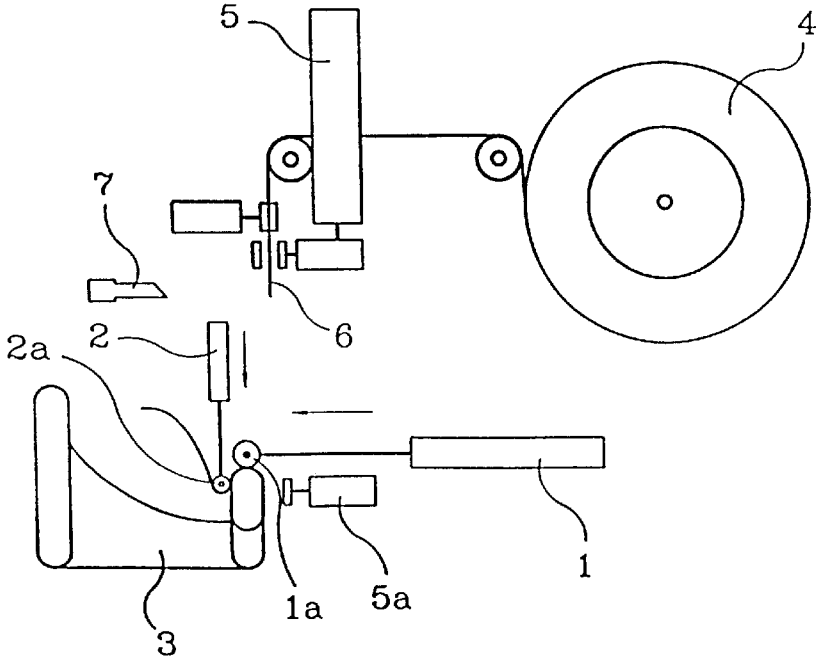
FIG. 1f PRIOR ART
Figure 2:
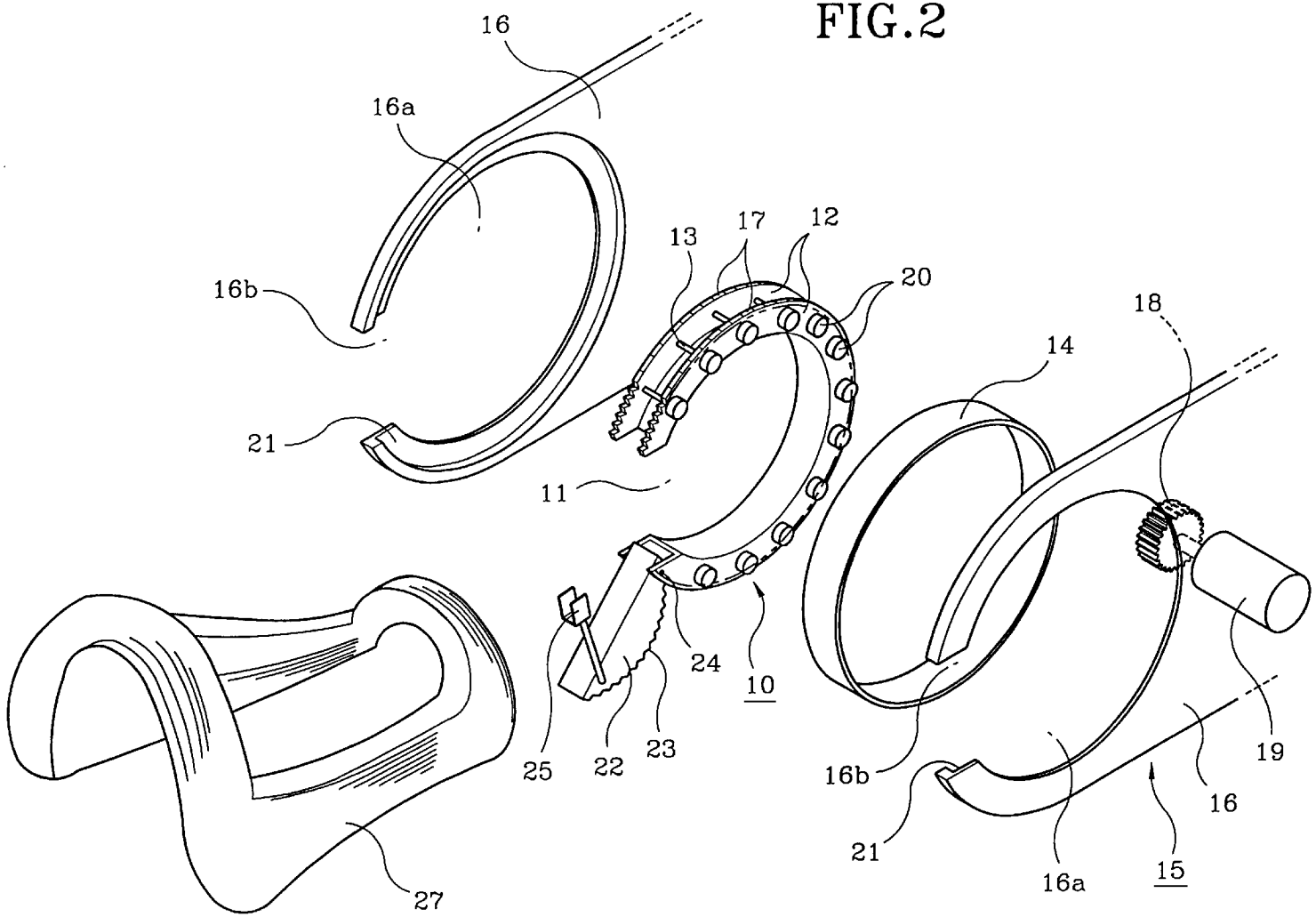
FIG. 2 is an exploded perspective view of the taping apparatus of the present invention.
Figure 3:
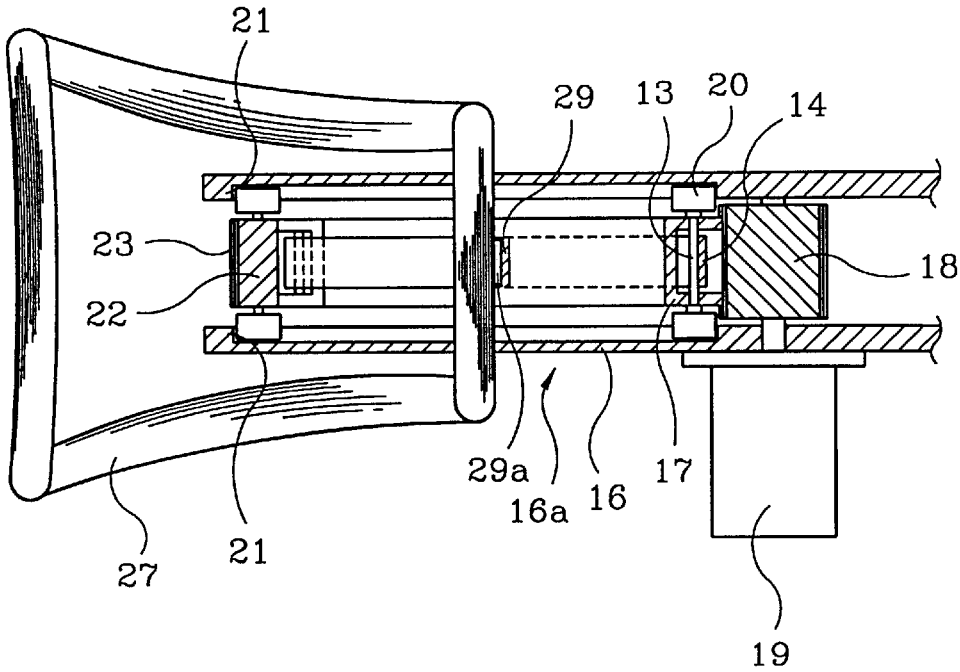
FIG. 3 is a cross-sectional plan view of the taping apparatus of the present invention.

FIG. 2 is an exploded perspective view of the taping apparatus of the present invention and FIG. 3 is a cross-sectional plan view thereof. The taping apparatus comprises an annular cam mechanism 10 for surrounding the peripheral surface of an object 27 to be taped, means 15 for rotating the cam mechanism 10, and a belt member 14 fitted around the circumferential surface of the cam mechanism 10 in such a manner that it can be rotated together with the cam mechanism 10 and simultaneously compress the tape to be applied against the peripheral surface of the object 27. The cam mechanism 10 is formed by bending a band plate with a constant width in an annular shape, and providing an entrance 11 through a portion thereof. Furthermore, the cam mechanism 10 is provided with flanges 12 with a constant height around front and rear sides thereof so as to prevent the belt member 14 from being taken off from the circumferential surface of the cam mechanism 10.

The entrance 11 is used as a passage for introducing a closed-loop shaped object 27 (e.g. a neck band which formed on the rear end of a horizontal deflection coil of a deflection yoke) into the central space of the cam mechanism 10, and the taping operation of tape 29 starts when the object 27 is positioned within the central space of the cam mechanism 10. A plurality of rotating guide pins 13 are horizontally extended between the flanges 12 and the belt member 14 is fitted over the guide pins 13. Therefore, a gap is present between the belt member 14 and the circumferential surface of the cam mechanism 10. Furthermore, the belt member 14 extends across the entrance 11 and in this position, the belt member is exposed to a part of the peripheral surface of the object 27 which is ready to be taped. The belt member 14 is formed from a rubber material having such a sufficient flexibility that it can be elongated when the object 27 is moved into the central space of the cam mechanism 10.

The rotating means 15 includes a pair of frames 16 for rotatively supporting the cam mechanism 10. These frames 16 are arranged at rear and front sides of the cam mechanism 10, respectively, and each frame 16 is provided with a hole 16*a,* the center of which coincides with that of the cam mechanism 10.

Preferably, the holes 16*a* have a dimension substantially the same as that of the internal circumferential surface of the cam mechanism 10, and each frame 16 is also provided with an entrance 16*b* corresponding to the entrance 11 formed in the cam mechanism 10, the entrance 16*b* communicating with the hole 16. Therefore, the object 27 does not interfere with any of the entrances 11 and 16*b* when it is moved into the central space of the cam mechanism 10. Furthermore, a circular rail 21 is formed on each of the internally opposing surfaces of the frames 16 along the periphery of the corresponding hole 16*a* to encircle one flange 12 of the cam mechanism 10. The flanges 12 are provided with a plurality of rolling members 20 around their outer surfaces, by which members the rotation of the cam mechanism 10 is smoothly guided between the frames 16. Furthermore, a number of external gear teeth are formed around the external circumferential surface of each flange 12, and a driving gear 18 meshing with the external gear teeth is provided to be rotatable between the frames 16.

The driving gear 18 is rotated by a motor 19 mounted on the outer surface of each frame 16, and a door 22 is mounted on a side of the entrance 11 formed in the cam mechanism 10. The door 22 is rotated about a hinge pin 24 by its weight and closes the entrance 11. The outer circumferential surface of the door 22 has a curvature substantially the same as that of the outer circumferential surface of the cam mechanism 10, and a number of teeth meshing with the driving gear 23 is formed on the outer circumferential surface of the door 22. Furthermore, within the inside of frames 16, there are provided stop pins 26 just below the hinge pin 24 of the door 22. Therefore, while the cam mechanism 10 is rotating, the door 22 can be pivoted about the hinge pin 24 under the condition that the external circumferential surface thereof abuts against the stop pins 26, whereby the entrance 11 can be automatically closed. And, a bearing member 25 is provided in the inside of the door 22, and when the door 22 is closed, the bearing member 28 pushes the tape 22 into tight contact with the surface of the belt member 14, so that there will be no gap created between the belt member 14 and the tape 29.

Figure 4A:
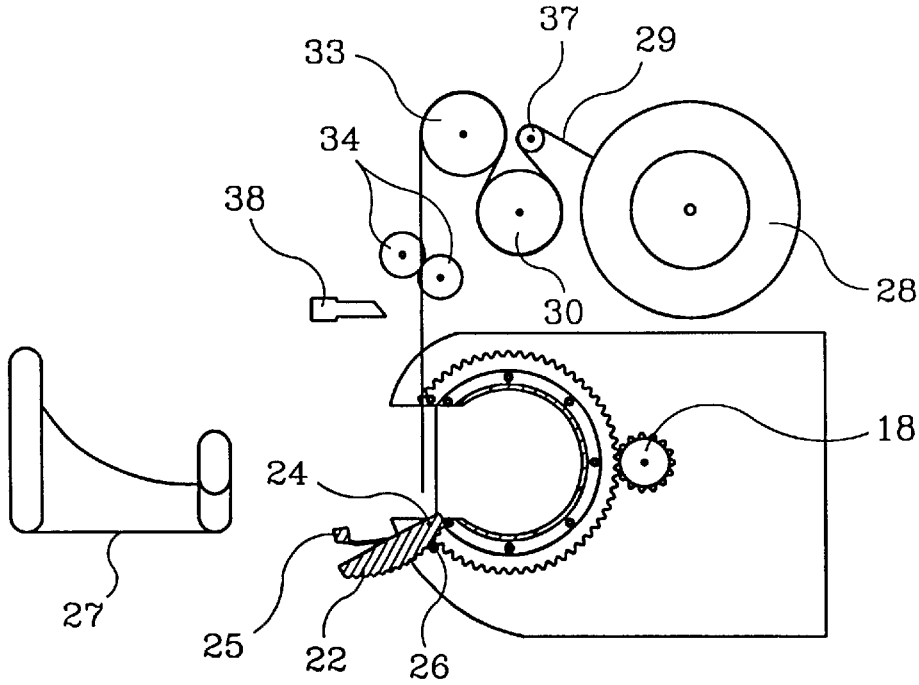
FIGS. 4*a* to 4*d* are front views diagrammatically showing the operating conditions of the taping apparatus of the present invention in sequence.

FIG. 4*a* is a schematic front view of the taping apparatus of the present invention. The tape 29 is unwound from a tape reel 22, moved through a driving roller 30, a driven roller 33 and positioning rollers 34, and then positioned parallel to the part of the belt member 14 facing toward the entrance 11. Then, if the object 27 is moved into the central space of the cam mechanism 10, the belt member 14 is stretched due to its flexibility and the tape 29 is tightly contacted to the external surface of the object 27. Thereafter, the tape 29 is cut to a desired length by a cutter 38 and then the belt member 14 makes the tape continuously contact with the external surface of the object 27 while the cam mechanism 10 rotates, in the course of which the cut tape 29 is compressed between the belt and the object, and wrapped around the peripheral surface of the object 27.

Figure 5:
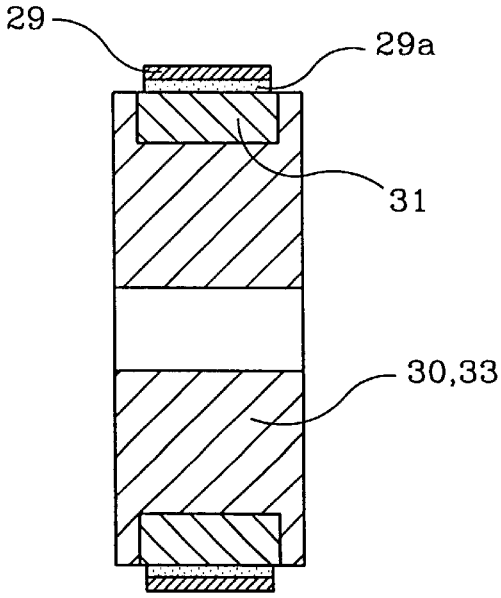
FIG. 5 is a cross-sectional view showing a driving roller and a driven roller of the taping apparatus of the present invention.

FIG. 5 is a partial section view showing the driving roller and the driven roller of the present invention. The driving roller 30 located at the left side of the tape reel 28 around which the tape 29 is wound is rotated by a driving means which is not shown. The driving roller 30 is coated with an adhesion-resistant film 31 along the periphery thereof, around a part of which the adhesive surface of the tape 29 is wrapped, and the tape is fed toward its unwinding direction while the driving roller 30 is rotating. Along a circumferential portion of the adhesion-resistant film 31 contacted with the tape, a frictional force is generated due to the close contact between the adhesion-resistant film 31 and the tape adhesive. However, either the tape winding portion or unwinding portion of the tape comes into or goes out of the end portions of the contacted part in the tangentially extended states and thus no frictional force is generated between the adhesion-resistant film and the tape any further. In other words, the part of the tape 29 which is circumferentially contacted with a part of the adhesion-resistant film 31 will be frictionally accompanied with the circumferentially contacted portion since the tape 29 is circumferentially extended and wrapped around that portion, whist at the opposite end portions of the contacted part, the tape will be separated from the surface of the adhesion-resistant film 31 since at those end portions the tape straightly extends in the tangential directions. Therefore, the tape 20 will be unwound from the tape reel and transferred in the desired direction by the frictional force generated between the surface of the adhesion-resistant film and the adhesive surface of the tape while the driving roller 30 is rotating. A guide roller is also provided for supporting the tape between the driving roller 30 and tape reel 28, so that the tape can be wrapped around the adhesion-resistant material 30 as wide as possible.

The driven roller 33 is located at the left upper side of the driving roller 32, so that the tape 20 can be sufficiently contacted to the adhesion-resistant film 31, thus generating a frictional force sufficient to move the tape. The driven roller 33 is also coated with a adhesive-resistant film. Therefore, when the adhesive surface 29*a* of the tape is contacted to the circumferential surface of the driven roller 33, a frictional force is also generated along the circumferential surface of the driven roller 33, whist at the opposite end portions of the contacted tape portion, no frictional force is generated since the tape is tangentially extended at those end portions and separated from the surface of the adhesive-resistant film coated along the periphery of the driven roller 33.

If the tape 29 has adhesive materials on its both sides, the adhesive material of one side will contact to the adhesion-resistant film 31 of the driving roller and the other side will contact to the adhesion-resistant film of the driven roller 33. In this process, the tape will frictionally accompanied with the driven roller 33, since the tape circumferentially wraps so sufficiently wide a portion of the adhesion-resistant film as to produce a frictional force. However, since the winding portion coming into the contacted portion and the unwinding portion going out of the contacted portion of the tape are tangentially extended from the ends of the contacted portion, the tape will separate from the surface of the adhesion-resistant film of the driven roller 33.

Figure 7:
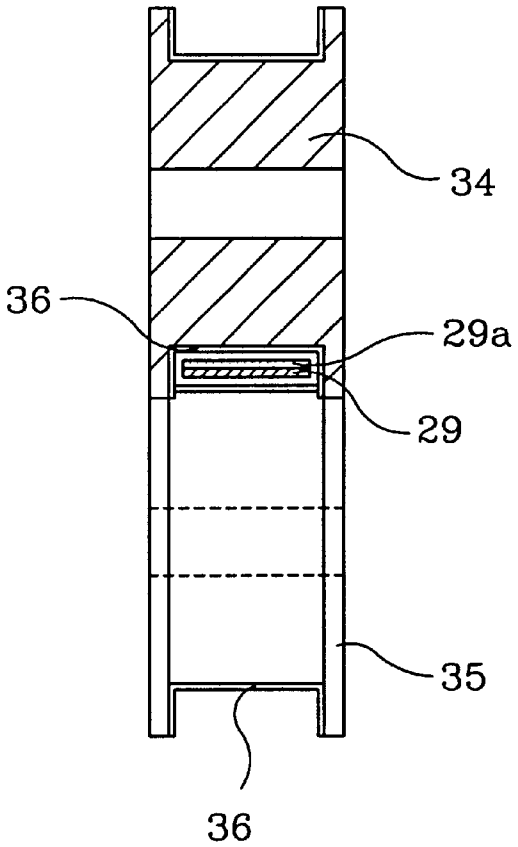
FIG. 7 is a cross-sectional view taken along the line A—A of FIG. 6.
Figure 6:
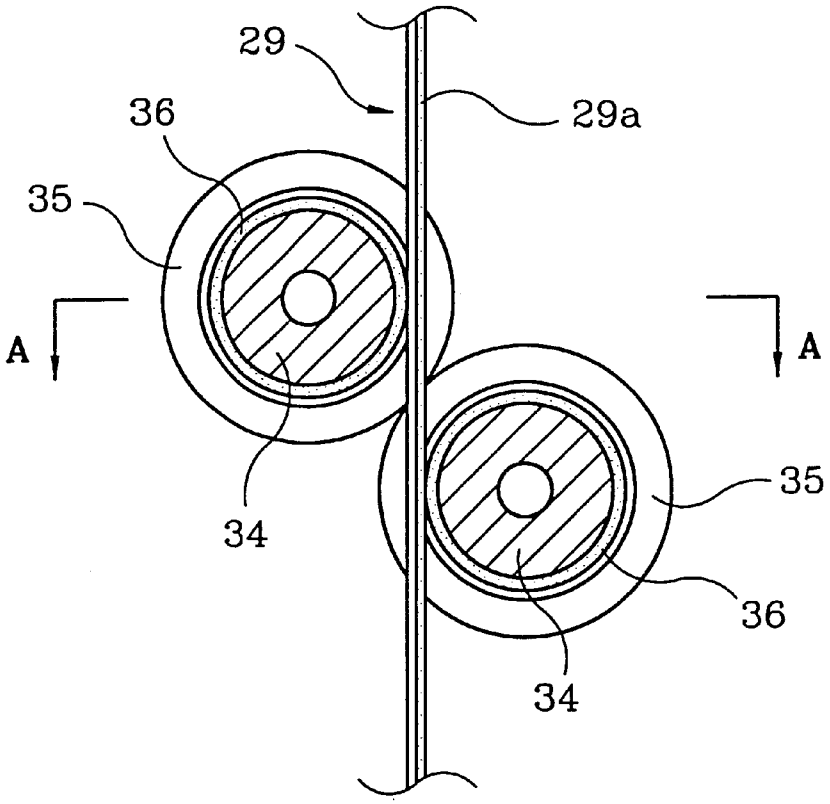
FIG. 6 is a front view showing in cross-section positioning rollers of the taping apparatus of the present invention.

FIG. 6 is a front view of the positioning rollers in cross-section and FIG. 7 is a sectional view taken along the line A—A of FIG. 6. A pair of positioning rollers 34 are provided just below the driven roller 33 for constantly retaining the running position of the tape 29. The positioning rollers 34 serve to guide the tape portion disposed between a part of the belt member 14 facing the entrance 11, and the object 27 to be taped. These positioning rollers 34 are alternately disposed in upper and lower positions, thus inhibiting tape shaking. A pair of flanges 35 are extended along the periphery of each positioning roller 34 for constantly retaining left and right longitudinal edges of the running tape 29, and thus the flanges 35 and each circumferential surface of the positioning rollers 34 form a running path of the tape 39. Furthermore, adhesion-resistant films 36 are coated on the circumference surfaces of positioning rollers 34 and on the corresponding surfaces of the flanges 35, so that the adhesive surface 29*a* of the tape will not interfere with the positioning rollers 34 and the flanges 35. Reference numeral 38 indicates a cutter for cutting the tape 29 to a predetermined length.

In the taping apparatus in accordance with the present invention constructed as explained herein-above, the door 22 pivots about the hinge pin 24 by its weight at the initial state, in which state the entrance 11 faces the object 27 to be taped, as shown in FIG. 4*a*, and thus the entrance 11 is opened. Furthermore, if the driving roller 30 rotates, the tape 29 is unwound from the tape reel 29 and runs through the positioning rollers 34. And then the tail of the tape 29 is further moved to the entrance 11, and the tape 20 is located parallel to the one side of the belt member 14 extended over the entrance 11.

Figure 4B:
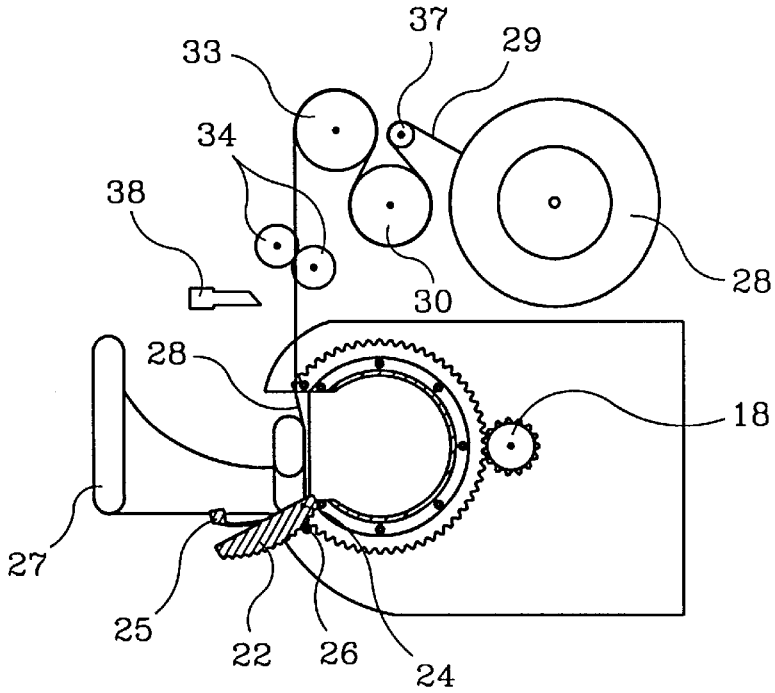
Figure 4C:
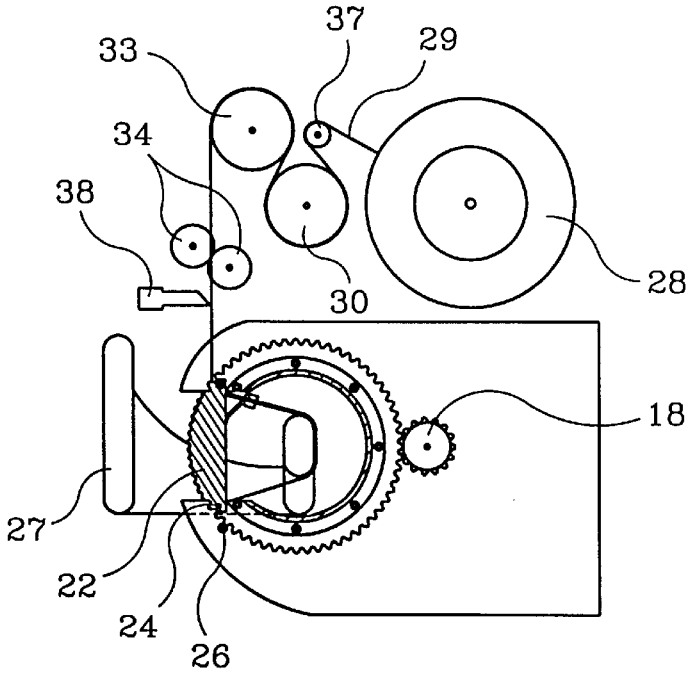
Figure 8:
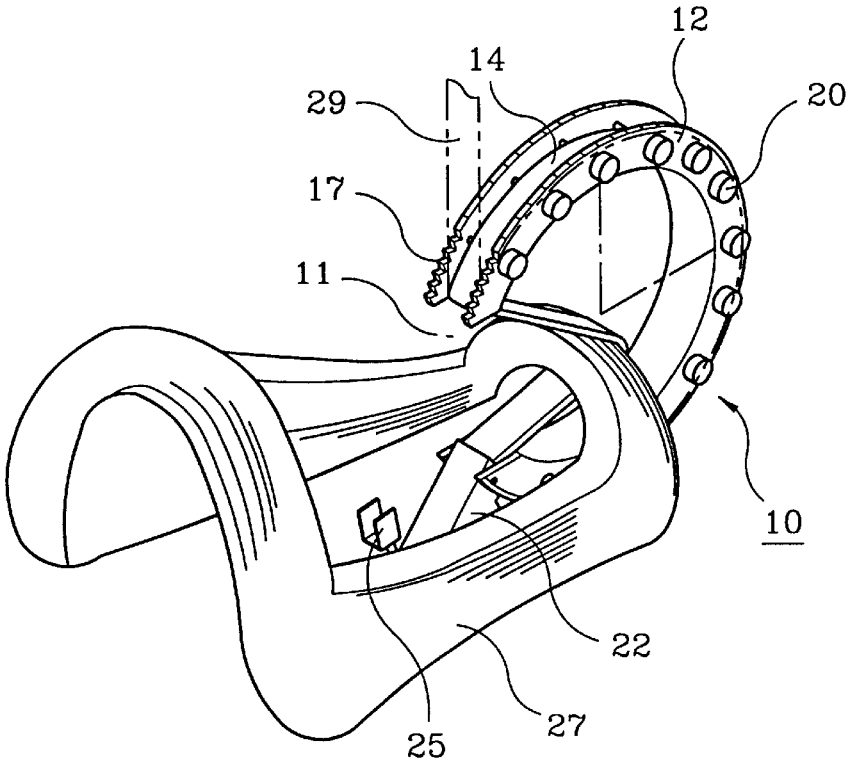
FIG. 8 is a perspective view showing the taping apparatus, into which an object is introduced.

As explained above, the tape 29 is moved by the frictional force generated between the tape and the adhesion-resistant film 31. Therefore, while the driving roller 30 is rotating, the tape is continuously moved by the frictional force. And, at each end of the contacted portion, the tape is always separated from the surface of the adhesion-resistance film 31, since the tape is either tangentially wound on or unwound from those end portions. The adhesion-resistant film 31 is formed from a material which does not adhere to the adhesive surface 29*a* of the tape, and thus the tape 29 can be easily released from the circumferential surface of the adhesion-resistant film 31 since no frictional force is generated when the tape 29 is tangentially wound on or unwound from the driving roller 30. Therefore, even through the tape 29 is circumferentially contacted on the surface of the driving roller 30, thus generating a frictional force, the tape is not permanently adhered to the surface of the driving roller 30 and can be easily released from the circumferential surface of the adhesion-resistant film when it is wound on or unwound from the driving roller, whereby the tape 29 can be continuously supplied. The tape portion unwound from the driving roller 30 will partially wrap around the circumferential surface of the driven roller 33 and can be continuously moved in the same manner as on the drawing roller 30. Finally, the tape 29 is supplied to the cam mechanism 10 through the positioning rollers 34. Thereafter, when the object 27 is moved toward the entrance 11 by a moving means such as a jig means, as shown in FIGS. 4*a*, 4*b* and 8, the tape 29 and the belt member 14 are pushed backward and the tape 29 is closely contacted to the periphery of the object by the tensioned belt member 14. Furthermore, when the object 27 is located at the central space of the cam mechanism 10, the movement of the tape is stopped. Simultaneously, the stopped tape 29 is cut to a predetermined length and then the taping operation of the tape 29 starts again.

Figure 4D:
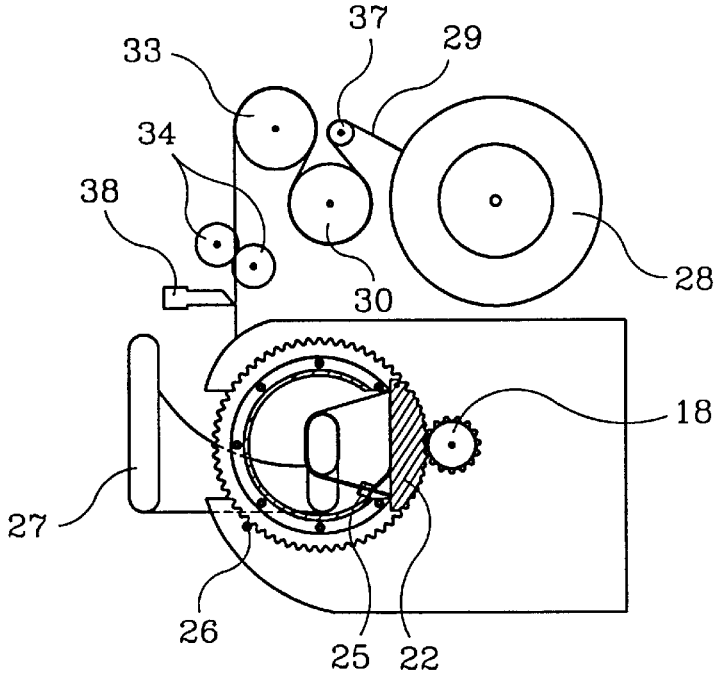
Figure 9:
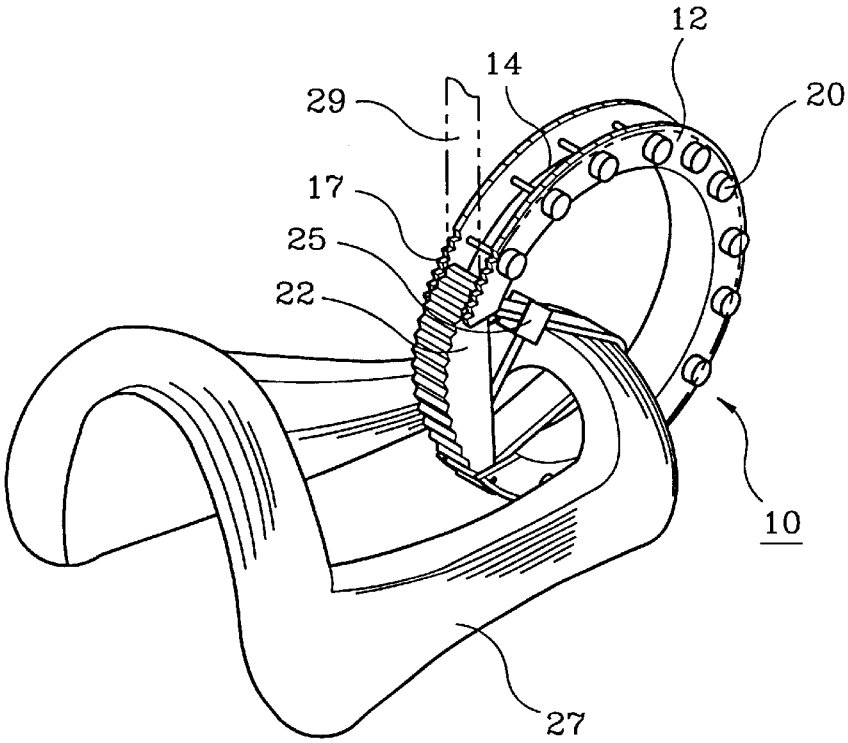
FIG. 9 is a perspective view showing the taping apparatus with the door thereof being closed.

As the taping operation starts, the rotation of the motor 19 makes the driving gear 18 rotate. If so, the cam mechanism 10 connected to the driving gear 18 though the externally toothed gears 17 rotates counter-clockwise as shown in FIGS. 4*e*, 4*d* and 9. The cam mechanism 10 smoothly rotates since a number of wheels 20 distributed along the outer opposite surfaces of frames 12 ride on the rails 21, and then the door 22 is pivoted about the hinge pin 24 by the stop pin 26 engaged with the door while the cam mechanism 10 rotates, thus closing the entrance 11. Then, the supporting member 25 provided inside the door 22 contacts the tape 29 and prevents the tape from leaving its path while taping is performed. While the cam mechanism 10 rotates, the belt member 14 is continuously contacted around the peripheral surface of the object and thus the tape 29 is applied around the peripheral surface in the compressed state. If the taping operation is completed, the rotation of the cam mechanism 10 is stopped and the door 22 faces the entrance 16*b* formed through the frames 16. When the cam mechanism 10 is stopped, entrances 11 and 16*b* are correspondingly located as shown in FIG. 4*a* and then the object 27 is pushed backward by a separate jig means. When the object 27 is pushed backward, the door is contacted by the object 27 and cooperates therewith. Then, the door 22 pivots about the hinge pin 24 by its weight and the entrances are opened, and during this process the object 27 is discharged.

As explained above, the tape applying apparatus in accordance with the present invention is provided with annular cam mechanism formed with an entrance radially through a part thereof and a flexible belt member located around the circumferential surface of the cam mechanism. Since the belt member is exposed through the entrance, the belt member is stretched and contacted by a loop-shaped object in the tensioned state as the object is introduced into the cam mechanism, whereby the tape portion sandwiched between the object and the belt member will be adhered to the peripheral surface of the object. Thereafter, while the cam mechanism is rotating in a direction by a rotating means, the belt member will be continuously contacted with the peripheral surface of the object and thus the tape can be applied around the object. Therefore, according to the present invention, a tape can be continuously applied around the peripheral surface of an object even though the object has a closed-loop shape, and thus the taping operation can be automatized.

What is claimed is:

1. A tape feeding system for a taping apparatus comprising:

a driving roller rotating in one direction;

an adhesion-resistant film coated on a peripheral surface of the driving roller, the film being capable of cooperating with a tape having at least one adhesive surface unwound from a tape reel so that the tape can be fed in a desired direction due to frictional force between the adhesion-resistant film and the adhesive surface contacted thereto in the circumferential direction; and a driven roller for guiding the tape so that the adhesive surface of the tape contacted to the adhesion-resistant film can sufficiently overlap and pass the peripheral surface of the driving roller.

2. The tape feeding system in accordance with claim 1 further comprising:

a pair of positioning rollers located below the driven roller and alternately arranged with reference to the tape path to be approached by each side of the tape;

pairs of flanges provided around each of the positioning rollers, each pair of flanges being spaced with an interspace corresponding to the width of the tape to guide the tape without fluctuation; and adhesion-resistant films coated on the periphery of each positioning roller and the corresponding surfaces of each flange to inhibit adhesion with the adhesive surfaces of the tape.

* * * * *